US007131271B2

(12) United States Patent
Bulicz et al.

(10) Patent No.: US 7,131,271 B2
(45) Date of Patent: Nov. 7, 2006

(54) CLEAN, LOW-PRESSURE EGR IN A TURBOCHARGED ENGINE BY BACK-PRESSURE CONTROL

(75) Inventors: Tytus R. Bulicz, Palos Hills, IL (US); Mahmoud S. El-Beshbeeshy, Mount Prospect, IL (US); Kai Chen, Villa Park, IL (US); Timothy J. Prochnau, Vernon Hills, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 529 days.

(21) Appl. No.: 10/650,177

(22) Filed: Aug. 28, 2003

(65) Prior Publication Data

US 2005/0045407 A1 Mar. 3, 2005

(51) Int. Cl.
*F02B 33/44* (2006.01)
*F02M 25/07* (2006.01)

(52) U.S. Cl. ..... 60/605.2; 123/568.12

(58) Field of Classification Search ..... 60/605.2; 123/568.12

See application file for complete search history.

(56) References Cited

U.S. PATENT DOCUMENTS

| | | | | |
|---|---|---|---|---|
| 4,215,550 | A | 8/1980 | Dinger et al. | 601/605.2 |
| 5,671,600 | A | 9/1997 | Pischinger et al. | |
| 5,771,867 | A | 6/1998 | Amstutz et al. | 601/605.21 |
| 6,000,222 | A | 12/1999 | Regnier | 601/605.2 |
| 6,263,672 | B1 | 7/2001 | Roby et al. | 601/605.2 |
| 6,301,887 | B1 * | 10/2001 | Gorel et al. | 60/605.2 |
| 6,422,217 | B1 * | 7/2002 | Feucht et al. | 60/605.2 |
| 6,651,432 | B1 * | 11/2003 | Gray, Jr. | 60/605.2 |
| 6,675,579 | B1 * | 1/2004 | Yang | 60/605.2 |
| 6,899,090 | B1 * | 5/2005 | Arnold | 60/605.2 |
| 6,973,786 | B1 * | 12/2005 | Liu et al. | 60/605.2 |
| 7,013,879 | B1 * | 3/2006 | Brookshire et al. | 60/605.2 |
| 2001/0047798 | A1 * | 12/2001 | Kawasaki | 123/568.12 |
| 2004/0093866 | A1 * | 5/2004 | Ishikawa | 60/605.2 |
| 2006/0042245 | A1 * | 3/2006 | Wimmer et al. | 60/605.2 |
| 2006/0054148 | A1 * | 3/2006 | Aberle | 60/605.2 |

* cited by examiner

*Primary Examiner*—Thai-Ba Trieu
(74) *Attorney, Agent, or Firm*—Susan L. Lukasik; Elias P. Soupos; Dennis K. Sullivan

(57) ABSTRACT

An engine system (20) includes an intake system (26) through which charge air enters combustion chambers, and an exhaust system (28) that includes a CDPF (34), through which products of combustion pass to the surrounding atmosphere. A throttle valve (36) is located in The exhaust system (28) downstream of both the CDPF (34) and the turbocharger turbine (30). An EGR flow path for recirculating exhaust gas from the exhaust system to the intake system includes an EGR valve (48) for controlling EGR flow. The EGR flow path is connected to the exhaust system upstream of the throttle valve and downstream of both the CDPF and the turbine, and to the intake system upstream of the turbocharger compressor Valves (36, 48) are under coordinated control provided by an engine control system (24) for selectively restricting the respective valves to attain desired EGR flow.

14 Claims, 1 Drawing Sheet

CLEAN, LOW-PRESSURE EGR IN A TURBOCHARGED ENGINE BY BACK-PRESSURE CONTROL

FIELD OF THE INVENTION

This invention relates to motor vehicles that are powered by internal combustion engines that use EGR (exhaust gas recirculation) as an element of their tailpipe emission control strategies. More specifically, the invention relates to systems and methods in turbocharged engines for obtaining clean, low-pressure EGR by exhaust back-pressure control.

BACKGROUND OF THE INVENTION

The recirculation of some engine exhaust gas is a recognized technique for achieving compliance with applicable tailpipe emission requirements. NOX emissions in particular. Various EGR strategies have been proposed for turbocharged engines, including diesel engines. Examples appear in U.S. Pat. Nos. 6,422,217; 6,263,672; 6,000,222; 5771,867; 5,671,600; and 4,215,550.

U.S. Pat. No. 6,422,217 describes a device that is placed in an engine exhaust system between the engine exhaust manifold and the turbocharger turbine. The device contains a valve mechanism for controlling engine back-pressure to induce recirculation flow through an EGR flow path to the engine intake system. The EGR flow path contains an EGR cooler. The cooled FOR flow enters a mixer where it entrains with charge air from the turbocharger compressor.

U.S. Pat. No. 6,263,672 describes a similar system having separate back-pressure and EGR valves instead of a single device.

U.S. Pat. No. 6,000,222 describes a turbocharger that integrates an EGR valve with the turbine housing. A back-pressure valve is fastened to the turbine housing. Although the patent contains no schematic diagram of EGR flow, it is believed that the reader is led to understand that the pierce point to the intake system is downstream of the turbocharger compressor.

U.S. Pat. No. 5,771,867 describes another system where the pierce point to the intake system is downstream of the turbocharger compressor.

U.S. Pat. No. 5,671,600 describes a system where the EGR pierce point to the exhaust system is upstream of the turbocharger turbine. The EGR flow path contains a particulate filter upstream of an EGR valve. The pierce point to the intake system is upstream of the turbocharger compressor.

U.S. Pat. No. 4,215,550 describes several systems some of which have the EGR pierce point to the exhaust system upstream of the turbocharger turbine and others of which have it downstream. The pierce point to the intake system is downstream of the turbocharger compressor.

An EGR system that has the pierce point to the exhaust system downstream of the turbocharger turbine may be considered a Low-Pressure EGR (LP EGR) system. Such a system possesses certain advantages. The extent to which such a system can provide increased EGR flow that is desired in order to eliminate more $NO_x$ from tailpipe emissions is limited by compressor inlet depression.

Throttling of engine intake flow is a known technique for achieving compressor inlet depression conducive to use of LP EGR.

SUMMARY OF THE INVENTION

The present invention is a consequence of the inventors' recognition that use of throttling of engine intake flow in order to accommodate LP EGR in a turbocharged engine imposes a fuel economy. Consequently, an objective of the present invention is to minimize, or even eliminate, that penalty.

For developing increased LP EGR flow, the invention contemplates use of a back-pressure control valve immediately downstream of the EGR pierce point to the engine exhaust system instead of an intake flow throttle. Although the use of back-pressure control is known, as discussed above, its use in conjunction with LP EGR in the manner contemplated herein by the present invention appears not to have heretofore recognized.

Moreover, when associated with an exhaust gas treatment system that has a diesel particulate filter (DPF), and especially a catalyzed DPF, the invention provides an important synergy in making the LP EGR flow clean. This is accomplished by making the EGR pierce point to the exhaust system downstream of the DPF as well as downstream of the turbocharger turbine. Hence, unlike the system described in U.S. Pat. No. 5,671,600, the EGR flow path need not contain a particulate filter downstream of the pierce point to the exhaust system.

While accomplishing the foregoing, the invention also provides advantages in the fabrication of certain engine system components and their packaging in a motor vehicle. For example, both an exhaust back-pressure control valve and LP EGR valve can be packaged as a single component or device that can be assembled in a motor vehicle outside the engine compartment, such as in an undercarriage of the vehicle rearward of the engine compartment. This has the potential for saving space in an engine compartment where available space is often at a premium.

Accordingly, one generic aspect of the present invention relates to a turbocharged engine system that has an intake system through which charge air enters combustion chambers to support combustion of fuel for running the engine and an exhaust system, including one or more exhaust gas treatment devices, through which products of combustion pass from the combustion chambers to the surrounding atmosphere. A throttle valve disposed in the exhaust system downstream of both the one or more exhaust gas treatment devices and a turbine of the turbocharger controls engine back-pressure. An EGR flow path for recirculating exhaust gas from the exhaust system to the intake system includes an EGR valve for controlling flow through the EGR flow path. The EGR flow path has a pierce point to the exhaust system upstream of the throttle valve and downstream of both the one or more exhaust gas treatment devices and the turbine. The EGR flow path has a pierce point to the intake system upstream of a compressor of the turbocharger.

Another generic aspect relates to a motor vehicle having a turbocharged internal combustion engine for propelling the vehicle, including an intake system through which charge air enters combustion chambers to support combustion of fuel for running the engine and an exhaust system, including one or more exhaust gas treatment devices, through which products of combustion pass from the combustion chambers to the surrounding atmosphere. A throttle valve is disposed in the exhaust system downstream of both the one or more exhaust gas treatment devices and a turbine of the turbocharger for controlling engine back-pressure. An EGR flow path for recirculating exhaust gas from the exhaust system to the intake system includes an EGR valve for controlling flow through the EGR flow path. The EGR flow path has a pierce point to the exhaust system upstream of the throttle valve and downstream of both the one or more exhaust gas treatment devices and the turbine. The EGR flow path has a pierce point to the intake system upstream of a compressor of the turbocharger.

Still another generic aspect relates to a method for low-pressure EGR control in a motor vehicle internal combustion engine having a turbocharger. Engine back-pressure is controlled by selectively restricting a throttle valve disposed in an exhaust system of the engine downstream of both the one or more exhaust gas treatment devices in the exhaust system and a turbine of the turbocharger. In conjunction with control of engine back-pressure, EGR flow to an intake system of the engine through an EGR flow path is controlled by selectively restricting an EGR valve in the EGR flow path. The EGR flow path has a pierce point to the exhaust system upstream of the throttle valve and downstream of both the one or more exhaust gas treatment devices and the turbine. The EGR flow path has a pierce point to the intake system upstream of a compressor of the turbocharger.

The foregoing, along with further features and advantages of the invention, will be seen in the following disclosure of a presently preferred embodiment of the invention depicting the best mode contemplated at this time for carrying out the invention. This specification includes a drawing, now briefly described as follows.

DESCRIPTION OF THE PREFERRED EMBODIMENT

Figure 1:
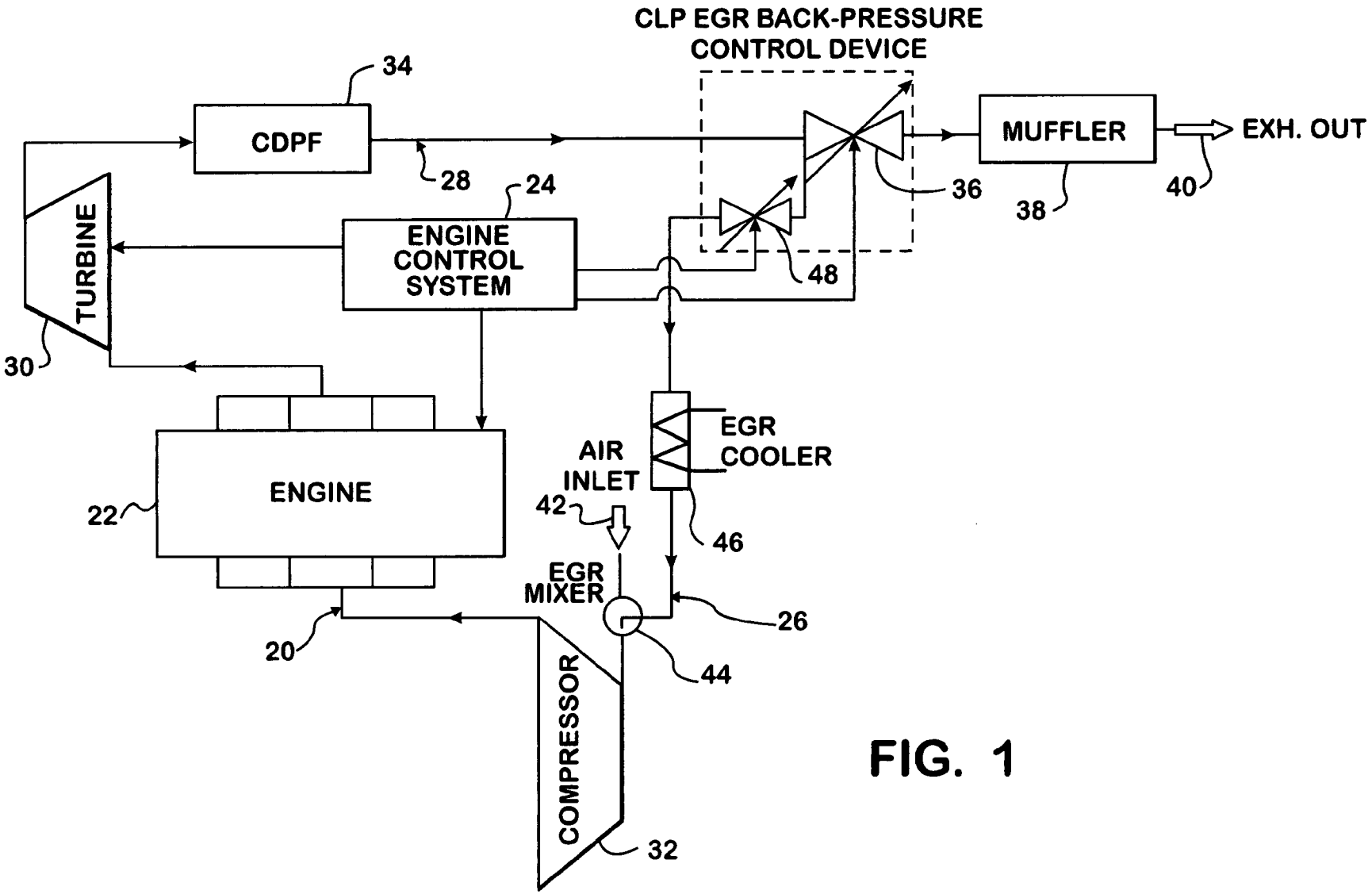
FIG. 1 is a general schematic diagram of an engine system embodying principles of the present invention.

FIG. 1 shows an engine system 20 embodying principles of the invention as an example of an internal combustion engine system of a motor vehicle. Engine system 20 comprises a diesel engine 22 under the control of a processor-based engine control system 24 that processes data from various sources to develop various control data for controlling various aspects of engine operation. The data processed by control system 24 may originate at external sources, such as sensors, and/or be generated internally. A processor of control system 24 can process data sufficiently fast to enable controlled functions to respond quickly to changes.

Engine system 20 further comprises an intake system 26 through which charge air enters combustion chambers of engine 22 and an exhaust system 28 through which exhaust gases resulting from combustion leave engine 22. Engine 22 is turbocharged by a turbocharger that comprises a turbine 30 in exhaust system 28 and a compressor 32 in intake system 26.

An inlet of turbine 30 is communicated to an exhaust manifold or manifolds (depending on whether engine 22 has an I- or V-configuration) so that hot engine exhaust gases resulting from combustion of fuel within engine 22 can operate the turbine. Exhaust system 28 further comprises a catalyzed diesel particulate filter (CDPF) 34 having an inlet communicated to an outlet of turbine 30. CDPF 34 is capable of physically trapping diesel particulate matter (DPM) in exhaust gas passing through exhaust system 28, thereby preventing significant amounts of DPM from being emitted to atmosphere. CDPF 34 also has an oxidation catalyst for oxidizing hydrocarbons (HC) and converting NO to $NO_2$, with the $NO_2$ being used to oxidize the trapped carbon to $CO_2$.

Exhaust system 28 further comprises a throttle valve 36 having an inlet communicated to an outlet of CDPF 34 and an outlet communicated to an inlet of a muffler 38 whose outlet opens to the surrounding air atmosphere through a tailpipe 40. A suitable mechanism for engine exhaust back-pressure control by throttle valve 36 is a butterfly that is positioned by an actuator under the control of control system 22 to selectively restrict exhaust gas flow through valve 36.

Intake system 26 comprises an air inlet 42 through which outside fresh air is drawn into the intake system. After particulates have been filtered from it by a filter (not shown), the fresh air flows through an EGR mixer 44 having one inlet communicated to air inlet 42 and an outlet communicated to an inlet of compressor 32. Mixer 44 has a second inlet that is communicated to an outlet of an EGR cooler 46. An inlet of EGR cooler 46 is communicated to an outlet of a low-pressure (LP) EGR valve 48 that has an inlet that is in common communication with the inlet of valve 36. LP EGR valve 48 is also under the control of control system 24 via a corresponding actuator.

When LP EGR valve 48 is allowing flow, some of the exhaust gases that have passed through CDPF 34 can recirculate through valve 48 and EGR cooler 46 to mixer 44 where they entrain with fresh outside air that is being drawn into intake system 26. The recirculation of some exhaust gas is a recognized technique for achieving compliance with applicable tailpipe emission requirements, particularly those concerning $NO_x$. The disclosed system enables clean low-pressure EGR to be achieved with less fuel economy penalty in comparison to use of throttled intake flow, and with synergy.

In order to boost clean LP EGR flow when such boost is needed, the operations of valve 36 and valve 48 are suitably coordinated via control system 24. LP EGR flow, back-pressure control valve 36 is operated to suitably restrict exhaust gas flow that has been subjected to upstream treatment for tailpipe emission compliance, especially substantial particulates for achieving clean EGR flow. The restriction develops exhaust back-pressure consistent with the extent to which control system 24 opens LP EGR valve 48 to provide the proper flow of clean LP EGR through EGR cooler 46 to EGR mixer 44. The ability to force more clean EGR flow into intake system 26 can reduce the $NO_x$ concentration in exhaust gases passing through muffler 40 and tailpipe 38 into the surrounding atmosphere.

Certain benefits in component fabrication and component installation in the assembly of a new motor vehicle can result from integrating valves 36 and 46 into a single component, here called a CLP EGR Back-Pressure Control Device. Such a device can be packaged in a motor vehicle outside of the vehicle engine compartment, such as in the exhaust system downstream of all exhaust after-treatments and upstream of the muffler. This allows the device to be placed in the undercarriage of the vehicle, rearward of an engine compartment that is more forward in the vehicle. The CLP EGR Back-Pressure Control Device requires only three piping connections, a first to CDPF 34, a second to muffler 38, and a third to EGR cooler 46. The common communication shared by the two valve inlets occurs internally of the Device. Electric connections to the two actuators of the Device occur via one or more electric connectors.

While a presently preferred embodiment of the invention has been illustrated and described, it should be appreciated that principles of the invention apply to all embodiments falling within the scope of the following claims.

What is claimed is:

1. A method for low-pressure EGR control in a motor vehicle internal combustion engine having a turbocharger and a device assembled as a unit into an exhaust system, that embodies a throttle valve and an EGR valve, the method comprising:

a) controlling engine back-pressure by selectively restricting the throttle valve disposed in the exhaust system of the engine downstream of both one or more exhaust gas treatment devices in the exhaust system and a turbine of the turbocharger in the exhaust system;

b) controlling, in conjunction with control of engine back-pressure, EGR flow to an intake system of the engine through an EGR flow path having a pierce point to the exhaust system upstream of the throttle valve and downstream of both the one or more exhaust gas treatment devices and the turbine and a pierce point to the intake system upstream of a compressor of the turbocharger in the intake system by selectively restricting the EGR valve in the EGR flow path to achieve desired EGR flow.

2. An engine system comprising:

a) an intake system through which charge air enters combustion chambers to support combustion of fuel for running the engine;

b) an exhaust system, including one or more exhaust gas treatment devices, through which products of combustion pass from the combustion chambers to the surrounding atmosphere;

c) a turbocharger having a turbine disposed in the exhaust system and a compressor disposed in the intake system;

d) a throttle valve disposed in the exhaust system downstream of both the one or more exhaust gas treatment devices and the turbine for controlling engine back-pressure;

e) an EGR flow path for recirculating exhaust gas from the exhaust system to the intake system, including an EGR valve for controlling flow through the EGR flow path, wherein the EGR flow path has a pierce point to the exhaust system upstream of the throttle valve and downstream of both the one or more exhaust gas treatment devices and the turbine;

f) wherein EGR flow path has a pierce point to the intake system upstream of the compressor, and wherein the throttle valve and the EGR valve are embodied in a device assembled as a unit into the exhaust system.

3. An engine system as set forth in claim 2 in which the exhaust system further comprises a muffler, and the throttle valve is disposed upstream of the muffler in the exhaust system.

4. An engine system as set forth in claim 2 in which one of the one or more exhaust gas treatment devices comprises a catalyzed diesel particulate filter.

5. An engine system as set forth in claim 2 further including an EGR cooler disposed in the EGR flow path between the EGR valve and the pierce point to the intake system.

6. An engine system as set forth in claim 2 in which the device is disposed downstream of both the one or more exhaust gas treatment devices and the turbine and upstream of a muffler of the exhaust system.

7. An engine system as set forth in claim 2 in which the throttle valve and the EGR valve are under control of an engine control system via respective actuators for selectively restricting the respective valves to attain desired EGR flow through the EGR flow path.

8. A motor vehicle comprising:

a) an internal combustion engine for propelling the vehicle, including an intake system through which charge air enters combustion chambers to support combustion of fuel for running the engine and an exhaust system, including one or more exhaust gas treatment devices, through which products of combustion pass from the combustion chambers to the surrounding atmosphere;

b) a turbocharger having a turbine disposed in the exhaust system and a compressor disposed in the intake system;

c) a throttle valve disposed in the exhaust system downstream of both the one or more exhaust gas treatment devices and the turbine for controlling engine back-pressure; and d) an EGR flow path for recirculating exhaust gas from the exhaust system to the intake system, including an EGR valve for controlling flow through the EGR flow path, wherein the EGR flow path has a pierce point to the exhaust system upstream of the throttle valve and downstream of both the one or more exhaust gas treatment devices and the turbine, and a pierce point to the intake system that is upstream of the compressor; and e) wherein the throttle valve and the EGR valve are embodied in a device assembled as a unit into the exhaust system.

9. A motor vehicle as set forth in claim 8 in which the exhaust system further comprises a muffler, and the throttle valve is disposed upstream of the muffler in the exhaust system.

10. A motor vehicle as set forth in claim 8 in which one of the one or more exhaust gas treatment devices comprises a catalyzed diesel particulate filter.

11. A motor vehicle as set forth in claim 8 further including an EGR cooler disposed in the EGR flow path between the EGR valve and the pierce point to the intake system.

12. A motor vehicle as set forth in claim 8 in which the a device is disposed downstream of both the one or more exhaust gas treatment devices and the turbine and upstream of a muffler of the exhaust system.

13. A motor vehicle as set forth in claim 8 in which the throttle valve and the EGR valve are under control of an engine control system via respective actuators for selectively restricting the respective valves to attain desired EGR flow through the EGR flow path.

14. A motor vehicle as set forth in claim 8 in which the vehicle has an engine compartment at the front of the vehicle and an undercarriage extending rearward from the engine compartment the engine is disposed in the engine compartment, and the device is placed in the undercarriage outside and rearward of the engine compartment.

* * * * *